US005957667A

United States Patent [19]

Epp

[11] Patent Number: 5,957,667

[45] Date of Patent: Sep. 28, 1999

[54] OILLESS COMPRESSOR WITH A PRESSURIZABLE CRANKCASE AND MOTOR CONTAINMENT VESSEL

[75] Inventor: Mark A. Epp, Langley, Canada

[73] Assignee: Ballard Generation Systems Inc., Burnaby, Canada

[21] Appl. No.: 08/862,638

[22] Filed: May 23, 1997

[51] Int. Cl.[6] ..... F04B 27/00

[52] U.S. Cl. ..... 417/271; 417/372; 417/366; 418/101

[58] Field of Search ..... 417/271, 273, 417/366, 371, 372, 201, 415

[56] References Cited

U.S. PATENT DOCUMENTS

| | | | |
|---|---|---|---|
| 2,040,507 | 5/1936 | Terry | 417/372 |
| 2,321,126 | 6/1943 | Breuer | 417/371 |
| 2,763,214 | 9/1956 | White | 417/371 |
| 4,743,176 | 5/1988 | Fry | 417/371 |
| 5,152,677 | 10/1992 | Bauer et al. | 417/366 |
| 5,263,826 | 11/1993 | Baumann et al. . | |
| 5,419,688 | 5/1995 | Basinski et al. . | |
| 5,515,769 | 5/1996 | Basinski et al. . | |
| 5,653,125 | 8/1997 | Boyanich | 417/372 |

*Primary Examiner*—Timothy S. Thorpe
*Assistant Examiner*—Cheryl J. Tyler
*Attorney, Agent, or Firm*—McAndrews, Held & Malloy, Ltd.

[57] ABSTRACT

An oilless gas compressor includes a motor containment vessel containing a motor for driving the compressor and a crankcase attached to the motor containment vessel. The crankcase and the motor containment vessel are fluidly connected and together define a sealed, pressurizable interior cavity in which the rotatable motor shaft is disposed. The compressor further includes a cylinder mounted upon the crankcase, the cylinder having a piston disposed therein. The piston is connected to the shaft for reciprocation of the piston within the cylinder. The cylinder also includes a gas intake valve, fluidly connected to the compressor suction inlet port, and a gas discharge valve, fluidly connected to the compressor discharge outlet port. The oilless gas compressor, in which the need for perimeter rotating shaft seals is obviated, is suitable for compression of precious or toxic gases or flammable gases, such as natural gas.

15 Claims, 2 Drawing Sheets

OILLESS COMPRESSOR WITH A PRESSURIZABLE CRANKCASE AND MOTOR CONTAINMENT VESSEL

FIELD OF THE INVENTION

The present invention relates to gas compressors. More particularly, the present invention relates to an oilless compressor with a sealed, pressurizable crankcase and motor containment vessel, suitable for compression of precious or toxic gases or combustible gases, such as natural gas.

BACKGROUND OF THE INVENTION

Reciprocating piston compressors typically employ piston rings as seals to reduce gas leakage during compression of a gas. Typically the seal is not perfect and, during the upstroke of the piston, some of the gas leaks from the cylinder chamber past the piston rings and into the crankcase. In the case of air compressors the leakage or blow-by gas is typically vented to the surrounding atmosphere from a ventilated crankcase without a significant adverse effect. In the case of precious, toxic or combustible gases, external leaks from the compressor are undesirable, and leakage gas is preferably recaptured.

Some conventional crankcases are sealed so that blow-by gas which leaks into the crankcase is ducted back to the cylinder intake valves. If the compressor is operated with the suction intake at an elevated pressure (relative to ambient), then the crankcase must be a pressurized crankcase, designed to operate and remain gas-tight at elevated internal pressures typically equal to or slightly greater than the suction pressure.

In conventional compressors, the drive motor is typically separate from the crankcase. Typically, the drive shaft for the compressor protrudes from the crankcase and may be directly coupled to the drive motor, or driven via a belt power transmission. The shaft protruding from the crankcase employs rotating shaft seals to prevent leakage of the gas being compressed and the lubrication oil from the crankcase. The crankcase typically acts as an oil reservoir. The oil provides lubrication and cooling for the main shaft bearings and connecting rod bearings. In addition, the rotating shaft seal is typically cooled and lubricated by the lubricating oil in the crankcase. Such lubricated, rotating shaft seals have demonstrated reliability and longevity even at crankcase pressures of 600 psig. However, with oil lubricated compressors small amounts of oil tend to become entrained or carried in the compressed gas stream discharged from the compressor.

For some applications, it may not be acceptable to have any oil present in the compressed gas stream delivered from the compressor. Such applications include food and medical applications. Also, in fuel cell power plants it is important that reactant streams delivered to the fuel cell stacks are not contaminated with traces of oil, as such impurities can cause damage to system components, in particular to the membrane electrode assemblies in solid polymer fuel cell stacks. Also, oil traces can adversely affect reactant processing equipment, such as for example reformation and selective oxidation apparatus and purification modules, through which the compressed gas stream is directed en route to the fuel cell stack. Thus, compression of reactant streams, such as for example natural gas, oxygen and hydrogen, for eventual downstream delivery to a fuel cell stack, should be accomplished without introducing traces of oil into the streams.

oilless compressors are known in which there is no oil anywhere in the compressor apparatus. Polytetrafluoroethylene piston rings, cast iron cylinders and greased and sealed roller bearings are typically employed in such compressors. However, unlubricated or dry running rotating shaft seals which operate reliably under pressurization without leakage are not readily available.

It is therefore desirable to provide an oilless gas compressor with a pressurizable crankcase and motor containment vessel, in which the need for perimeter rotating shaft seals is obviated.

SUMMARY OF THE INVENTION

An oilless gas compressor comprises:

- a motor containment vessel containing a motor for driving the compressor, the motor comprising a stator and a rotor;
- a crankcase attached to the motor containment vessel, the crankcase and the motor containment vessel fluidly connected and together defining a sealed, pressurizable interior cavity;
- a shaft disposed entirely in the interior cavity, the shaft rotatable by the motor;
- a cylinder mounted upon the crankcase, the cylinder comprising a piston, the piston connected to the shaft for reciprocation of the piston within the cylinder, the cylinder further comprising a gas intake valve and a gas discharge valve;
- a suction inlet port fluidly connected to the gas intake valve; and
- a discharge outlet port fluidly connected to the gas discharge valve.

In operation, there are preferably no exterior openings, rotating shaft seals or other dynamic seals at the perimeter of the oilless gas compressor which, particularly under pressure, could create a fluid connection between the interior cavity and the surrounding atmosphere resulting in leakage.

Optionally, the motor may further comprise a motor housing encasing the stator and the rotor, with the motor containment vessel of the compressor enclosing the motor housing.

In preferred embodiments of an oilless gas compressor, the interior cavity is pressurizable to a pressure greater than 5 psig.

In operation, the suction inlet port of the oilless gas compressor may be fluidly connected to a natural gas supply, wherein the natural gas supply is preferably at a pressure greater than 5 psig.

In some embodiments of an oilless gas compressor, the suction inlet port may be formed in the motor containment vessel. In such embodiments, the incoming suction gas may be used to cool the compressor motor. For example, the suction inlet port may be fluidly connected to the cylinder intake valve via a passage, a portion of the passage extending through the motor, for cooling the motor with gas entering the compressor at the suction inlet port.

In other embodiments of an oilless gas compressor, the suction inlet port may be formed in the crankcase.

In still further embodiments of an oilless gas compressor, the suction inlet port may be formed in the cylinder, with the compressor further comprising a bypass conduit for placing the interior cavity in fluid communication with the cylinder.

Preferably, the oilless gas compressor comprises a plurality of cylinders, such as, for example, a pair of opposed cylinders aligned along a common axis or in some other configuration, or three cylinders.

For cooling of the oilless gas compressor, which is typically required, the compressor may further comprise an externally mounted fan, located outside the interior cavity. In preferred cooling configurations, the fan may be driven by the same motor and shaft that drives the compressor via a magnetic coupling, or the fan may be driven by a second motor disposed outside the interior cavity. In addition, or alternatively, the one or more cylinders may comprise a cooling jacket for liquid cooling by a circulated coolant fluid.

DETAILED DESCRIPTION OF THE PREFERRED EMBODIMENTS

Figure 1:
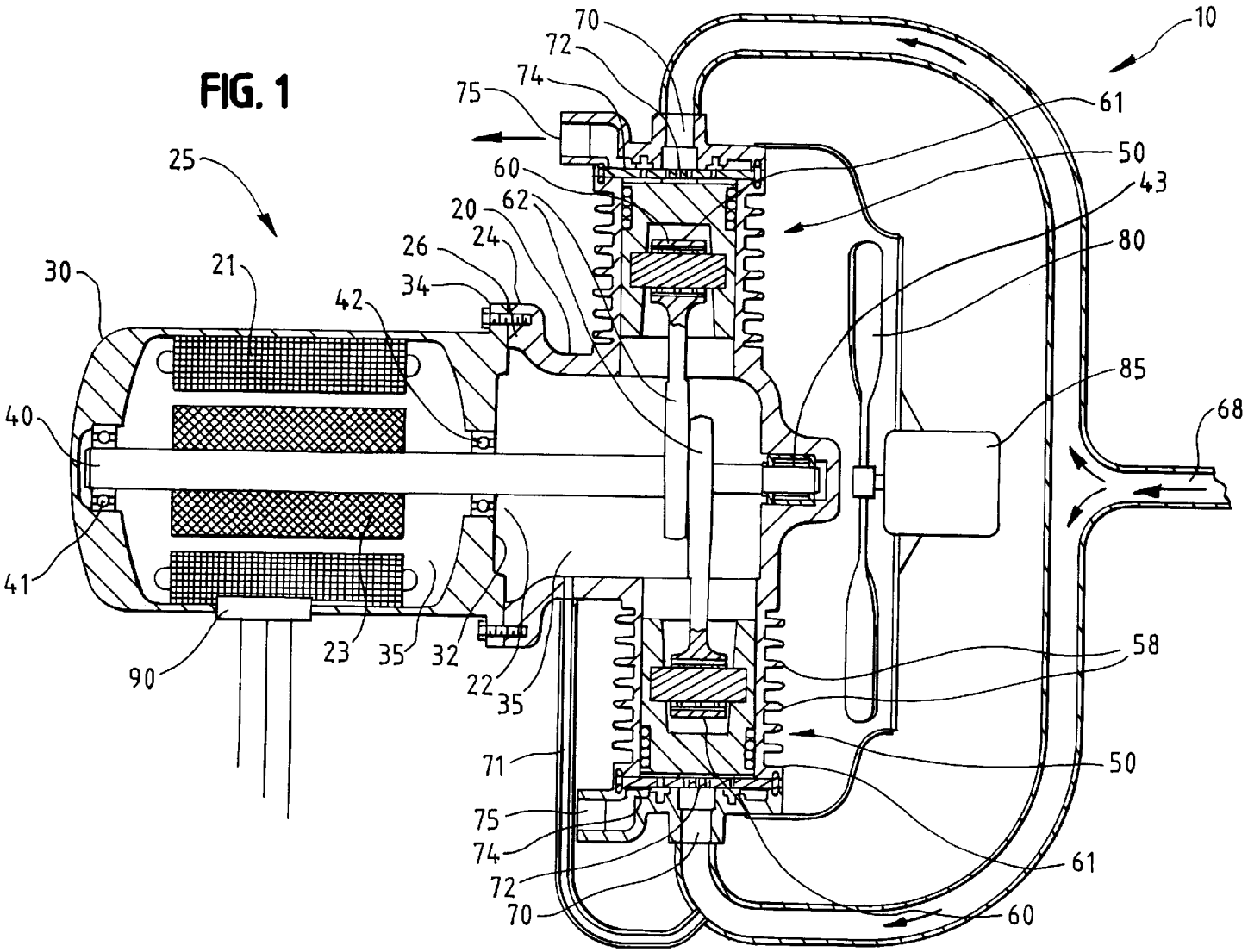
FIG. 1 is a sectional view of an oilless reciprocating piston compressor with a sealed, pressurizable crankcase fluidly connected to a motor, wherein the motor housing acts as a pressurizable motor containment vessel.

FIG. 1 shows an oilless reciprocating piston compressor 10 with a crankcase 20. A rotary electric motor 25 (such as, for example, a C-face motor) comprising a stator 21 and a rotor 23, is contained in a motor housing 30, which, in the illustrated embodiment, acts as a pressurizable containment vessel for the motor. One face 32 of motor housing 30 is mounted across an opening 22 in crankcase 20 by means of two cooperating flanges 24 and 34, on the crankcase 20 and motor housing 30, respectively. Flanges 24 and 34 are bolted together with a gasket or O-ring seal 26 interposed therebetween to form a static seal between crankcase 20 and motor housing 30. The rotor 23 is mounted on a motor shaft 40, which protrudes from motor housing 30 and extends into the crankcase 20. The shaft 40 is supported by three bearings 41, 42 and 43. In isolation, motor housing 30 is fluid-tight under pressure except around the front bearings 42 which surround motor shaft 40. The interior volume of the crankcase 20 and the motor housing 30 are thus fluidly connected to each other via region around the front motor shaft bearings 42, together forming an interior cavity 35. Shaft 40 is contained entirely within the interior cavity 35. Because there is a static seal, between the crankcase 20 and the motor housing 30, which circumscribes the motor shaft 40, and in operation there are no exterior openings or rotating shaft seals at the perimeter of the compressor, the interior cavity 35 is fluidly isolated from the surrounding atmosphere. The motor housing 30 thus becomes an extension of the pressure containment structure of the crankcase 20. The crankcase 20 and motor housing 30 are designed to be pressurizable to differential pressures (relative to the surrounding atmosphere) of at least 5 psig, and preferably at least 10 psig. In the embodiment illustrated in FIG. 1 the crankcase 20 is approximately 0.75 inch thick steel, and the motor housing 30 is approximately 0.25 inch thick steel.

Three cylinders 50 are mounted on crankcase 20 (only two are shown in FIG. 1; the third is mounted orthogonal to the two shown). Each cylinder houses a piston 60 which is connected to motor shaft 40 via an eccentric bearing and connecting rod 62 so that rotation of the motor shaft 40 causes reciprocation of the pistons 60 in cylinders 50. Cylinders 50 are non-lubricated, and polytetrafluoroethylene piston rings 61 are employed.

The gas supply line 68 is connected to a gas supply (not shown), and is branched for connection to the suction inlet 70 at the head of each cylinder 50. The gas enters the compressor 10 at suction inlets 70 and enters the cylinders via cylinder intake valves 72 which are open during the downstroke of the pistons 60. The gas is compressed in the cylinder 50 on the upstroke and exits the cylinder at discharge outlet port 75 via discharge valve 74. Preferably, from the discharge outlet ports 75 the gas is directed to a pulsation damper or cushion chamber (not shown) which damps out pressure variations to provide more uniform flow in the pressurized gas supply. The interior cavity 35 is fluidly connected to the gas supply line 68 via bypass line 71, so that blow-by gas is ducted back to the cylinder intake valves 72.

The electrical connections to the motor 25 in the interior cavity 35 are made via hermetic seal 90.

In the embodiment illustrated in FIG. 1, a fan is 80 is mounted on the exterior of the crankcase. In operation the fan, which is driven by a dedicated motor 85, directs cooling air over the crankcase 20 and cylinders 50. The cylinders typically include fins 58 to facilitate cooling.

In another variation, the cylinders 50 could be cooled using liquid cooling jackets through which a coolant is circulated. The motor 25 may be a high temperature motor which does not require active cooling, or it too may be cooled, for example, by using a fan, blower or a liquid cooling jacket. A cover which fits over the compressor may be employed to direct the cooling air around any of the cylinders, crankcase and motor, and to attenuate the sound.

Figure 2:
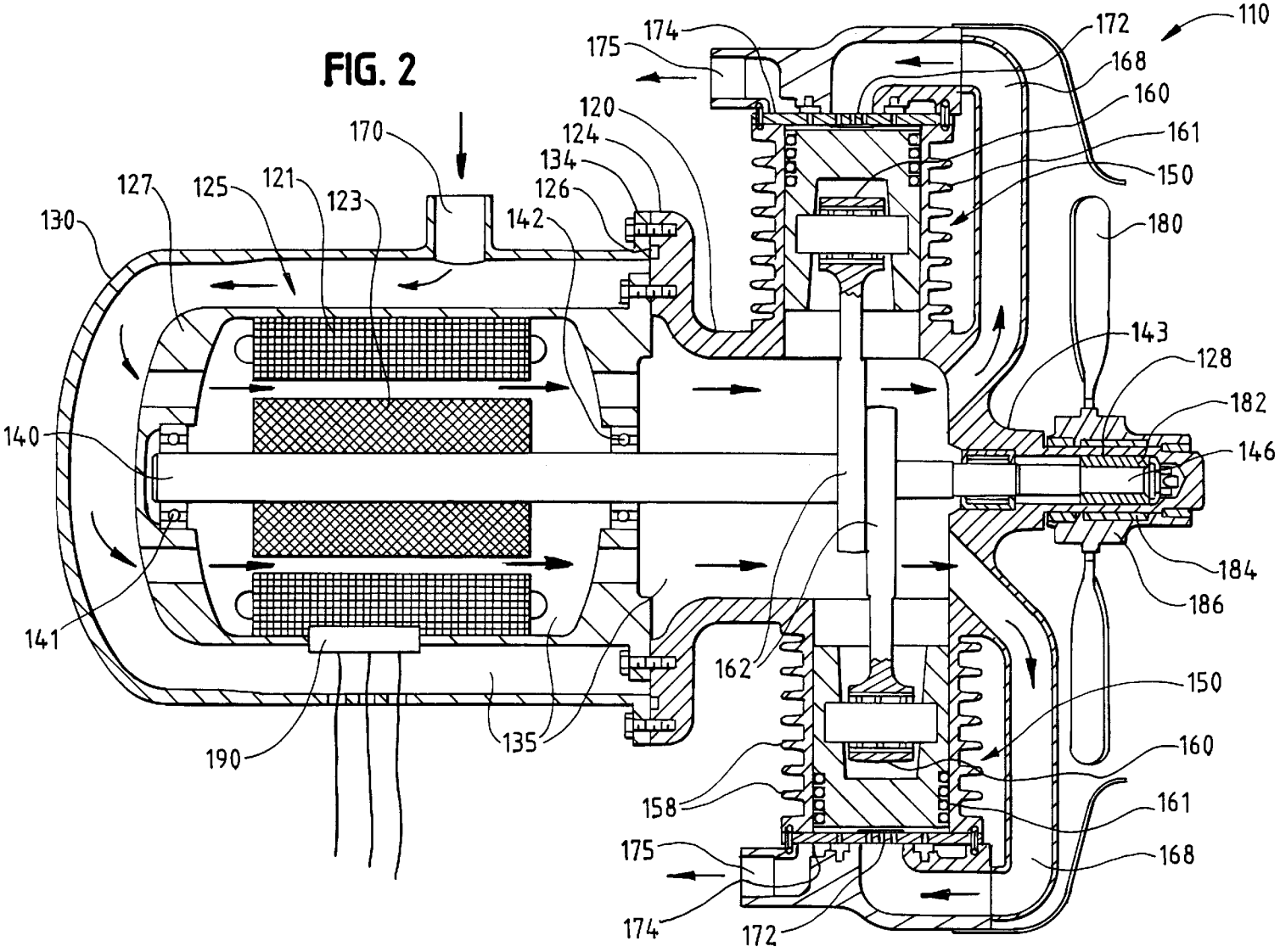
FIG. 2 is a sectional view of an oilless reciprocating piston compressor with a sealed, pressurizable crankcase fluidly connected to a pressurizable motor containment vessel, wherein the motor is cooled by the incoming suction gas.

FIG. 2 shows an oilless reciprocating piston compressor 110, which is similar to compressor 10 shown in FIG. 1. A bell-shaped pressurizable motor containment vessel 130 is connected to crankcase 120 by means of two cooperating flanges 124 and 134, on the crankcase 120 and motor containment vessel 130, respectively. Flanges 124 and 134 are bolted together with a gasket or O-ring seal 126 interposed therebetween to form a static seal. The crankcase 120 and motor containment vessel 130 cooperate to define an interior cavity 135 which, in operation, is fluidly isolated from the surrounding atmosphere. The motor containment vessel 130 thus becomes an extension of the pressure containment structure of the crankcase 120. The crankcase 120 and motor containment vessel 130 are designed to be pressurizable to differential pressures (relative to the surrounding atmosphere) of at least 5 psig, and preferably at least 10 psig. In the embodiment illustrated in FIG. 2, the crankcase 120 is approximately 0.75 inch thick steel, and the motor containment vessel 130 is approximately 0.25 inch thick steel. A rotary motor 125, comprising a stator 121 and rotor 123 in a ventilated motor housing 127, is contained in motor containment vessel 130. The rotor 123 is mounted on a motor shaft 140, which protrudes from motor housing 127 and extends into the crankcase 120. The shaft 140 is supported by three bearings 141, 142 and 143.

As in FIG. 1, three non-lubricated cylinders 150 are mounted on crankcase 120 (only two are shown in FIG. 2; the third is mounted orthogonal to the two shown), each housing a piston 160 which is connected to motor shaft 140, for reciprocation, via an eccentric bearing and connecting rod 162. Cylinders 150 are non-lubricated, and polytetrafluoroethylene piston rings 161 are employed.

Suction inlet 170 opens directly into the interior cavity 135. In operation, compressor suction inlet 170 is connected to a gas supply, such as a pressurized natural gas supply (not shown). In the embodiment illustrated in FIG. 2, the motor 125 is cooled by the incoming suction gas. Thus, the gas enters the compressor 110 at suction inlet 170 and is directed between the motor containment vessel 130 and the motor housing 127 then between the stator 121 and rotor 123 of motor 125, to cool the motor. The incoming gas is thus forced to pass though the interior of the housing 127. The gas is then directed into the crankcase section of the interior cavity 135, where it also cools the connecting rod 162 bearings. From the crankcase cavity the gas is directed via conduits such as lines 168 to cylinder intake valves 172 which are open during the downstroke of the pistons 160. The gas is compressed in the cylinder 150 on the upstroke and exits the cylinder at discharge outlet port 175 via discharge valve 174. Any gas which leaks past the pistons 160 on the compression stroke will be captured in the crankcase section of the interior cavity 135 and will be recirculated back to the cylinder intakes 172 via lines 168.

Again, the electrical connections to the motor 125 in the interior cavity 135 are made via hermetic seal 190.

Again, in the embodiment illustrated in FIG. 2, a cooling fan is 180 is mounted on the exterior of the crankcase, and is magnetically coupled to be driven by motor shaft 140 which also drives the compressor, without the need for a perimeter rotating shaft seal. No perimeter rotating shaft seal is required in the crankcase or motor containment vessel wall as the motor shaft 140 is fully enclosed within the interior cavity 135. A protruding section 128 of the crankcase 120 encloses an extension 146 of the motor shaft 140. An inner magnetic coupling sleeve 182 is fitted on the extension 146 of shaft 140, and an outer magnetic coupling sleeve 184 is fitted between the protruding crankcase section 128 and the hub 186 of the fan 180. In operation the fan directs cooling air over the crankcase 120 and cylinders 150. The cylinders typically include fins 158 to facilitate cooling.

In both of the illustrated embodiments, only static seals are employed to isolate the interior cavity of the oilless gas compressor from the surrounding atmosphere. No rotating shaft seals or other dynamic seals are employed at the perimeter of the compressor for this purpose, as they would be vulnerable to leakage, especially when a pressure differential is applied across the seal.

The oilless gas compressors illustrated in FIGS. 1 and 2 are suitable for the compression of natural gas without leakage, for example, to produce an oil-free compressed natural gas stream at a discharge pressure of approximately 100–115 psig when operated at an intake pressure of approximately 10 psig.

The present approach is applicable to many different reciprocating piston compressor designs. For example, the number and orientation of the cylinders is not important; the compressor may incorporate single- or double-acting reciprocating pistons; and, the compressor may be a single-stage compressor or a multi-stage compressor with intercooling. Further, this approach could be used with other types of oilless gas compressors including centrifugal, screw and scroll compressors, rotary compressors including rotary vane and rotary lobe compressors, and also with blowers.

While particular elements, embodiments and applications of the present invention have been shown and described, it will be understood, of course, that the invention is not limited thereto since modifications may be made by those skilled in the art, particularly in light of the foregoing teachings. It is therefore contemplated by the appended claims to cover such modifications as incorporate those features which come within the spirit and scope of the invention.

We claim:

1. An oilless gas compressor comprising:

a motor containment vessel containing a motor for driving said compressor, said motor comprising a stator and a rotor;

a crankcase attached to said motor containment vessel, said crankcase and said motor containment vessel fluidly connected and together defining a sealed, pressurized interior cavity during operation of the compressor;

a shaft disposed entirely in said interior cavity, said shaft rotatable by said motor;

a cylinder mounted upon said crankcase, said cylinder comprising a piston, said piston connected to said shaft for reciprocation of said piston within said cylinder, said cylinder further comprising a gas intake valve and a gas discharge valve;

a suction inlet port fluidly connected to a fluid passage; said passage comprising a first conduit, fluidly connected to said gas intake valve, and a second conduit, fluidly connected and adjacent to at least one inlet of said gas intake valve and to said pressurized interior cavity for recovering blow-by gas;

a discharge outlet port fluidly connected to said gas discharge valve.

2. The oilless gas compressor of claim 1 wherein said motor further comprises a motor housing encasing said stator and said rotor.

3. The oilless gas compressor of claim 1 further comprising static seals disposed between said crankcase and said motor containment vessel, whereby during operation of the compressor said interior cavity is pressurized to a pressure greater than 5 psig.

4. The oilless gas compressor of claim 1 wherein said suction inlet port is fluidly connected to a natural gas supply.

5. The oilless gas compressor of claim 1 wherein said suction inlet port is formed in said motor containment vessel.

6. The oilless gas compressor of claim 5 wherein said suction inlet port is fluidly connected to said gas intake valve via a passage a portion of said passage extending through said motor, for cooling said motor with gas entering said compressor at said suction inlet port.

7. The oilless gas compressor of claim 1 wherein said suction inlet port is formed in said cylinder, and said compressor further comprises a bypass conduit for placing said interior cavity in fluid communication with said gas intake valve.

8. The oilless gas compressor of claim 1 wherein said compressor comprises a plurality of cylinders.

9. The oilless gas compressor of claim 8 wherein said plurality of cylinders is a pair of opposed cylinders aligned along a common axis.

10. The oilless gas compressor of claim 8 wherein said plurality of cylinders is three cylinders.

11. The oilless gas compressor of claim 1 wherein said cylinder is non-lubricated.

12. The oilless gas compressor of claim 11 further comprising at least one piston ring associated with said piston, said at least one piston ring being formed of polytetrafluoroethylene.

13. The oilless gas compressor of claim 11 further comprising an externally mounted fan for cooling said compressor.

14. The oilless gas compressor of claim 11 wherein said cylinder comprises a cooling jacket for liquid cooling by a circulated coolant liquid.

15. The oilless gas compressor of claim 1 further comprising at least one fluid passage extending through an interior wall between said motor containment vessel and an interior portion of said crankcase housing said shaft.

* * * * *